US012507795B2

(12) United States Patent
Chen et al.

(10) Patent No.: US 12,507,795 B2
(45) Date of Patent: Dec. 30, 2025

(54) FOLDING DESK

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 59 days.

(21) Appl. No.: 18/670,799

(22) Filed: May 22, 2024

(65) Prior Publication Data

US 2025/0359661 A1 Nov. 27, 2025

(30) Foreign Application Priority Data

Mar. 22, 2023 (CN) ..... 202320580991.X

(51) Int. Cl.
*A47B 3/00* (2006.01)
*A47B 3/12* (2006.01)
*A47B 9/20* (2006.01)

(52) U.S. Cl.
CPC ..... *A47B 3/002* (2013.01); *A47B 3/12* (2013.01); *A47B 9/20* (2013.01); *A47B 2200/0035* (2013.01); *A47B 2200/0052* (2013.01)

(58) Field of Classification Search
CPC ..... A47B 3/002; A47B 3/083; A47B 3/087; A47B 3/091; A47B 3/12; A47B 2003/0835; A47B 9/20
See application file for complete search history.

(56) References Cited

U.S. PATENT DOCUMENTS 6,026,751 A * 2/2000 Tsai ..... A47B 3/00 108/115
6,158,361 A * 12/2000 Zheng ..... A47B 3/12 108/118
6,283,045 B1 * 9/2001 Izumi ..... A47B 3/087 108/115
6,640,730 B2 * 11/2003 Tsai ..... A47B 3/04 108/115
2007/0277709 A1 * 12/2007 Carter ..... A47B 3/12 108/115
2009/0000522 A1 * 1/2009 Collins ..... B25H 1/04 108/115
2009/0241811 A1 * 10/2009 Markegard ..... A47B 3/00 108/118
2012/0304901 A1 * 12/2012 Volin ..... A47B 3/091 108/127

(Continued)

*Primary Examiner* — Daniel J Rohrhoff
(74) *Attorney, Agent, or Firm* — Bayramoglu Law Offices

(57) ABSTRACT

A folding desk includes a desk body and a desk board. The desk body includes four support mechanisms, two first linkage mechanisms and two second linkage mechanisms, the support mechanisms include upright rods and cross beam rods with ends hinged together, four upright rods are distributed in a rectangle, and first connection pieces slidable along the upright rods are disposed on the upright rods respectively. The two upright rods at short sides of the rectangle are connected by the first linkage mechanism. Two upright rods on long sides of the rectangle are connected by the second linkage mechanism, and each second linkage mechanism includes a second connection piece and four second linkage rods. Two cross beam rods on a same long side of the rectangle are placed on the second connection piece and located in a same straight line. The desk board is placed on the four cross beam rods.

10 Claims, 5 Drawing Sheets

(56) References Cited

U.S. PATENT DOCUMENTS

| | | | | |
|---|---|---|---|---|
| 2017/0238696 | A1* | 8/2017 | Ehrreich | A47B 9/20 |
| 2022/0240664 | A1* | 8/2022 | Choi | A47B 3/087 |
| 2025/0241439 | A1* | 7/2025 | Tsai | A47B 3/06 |

* cited by examiner

FOLDING DESK

CROSS REFERENCE TO THE RELATED APPLICATIONS

This application is based upon and claims priority to Chinese Patent Application No. 202320580991.X, filed on Mar. 22, 2023, the entire contents of which are incorporated herein by reference.

TECHNICAL FIELD

The present disclosure relates to the technical field of desks and in particular to a folding desk.

BACKGROUND

Desks, for example, portable folding desks are often used outdoors. But, the existing folding desks have poor stability, large folding volume and inconvenience of carriage.

SUMMARY

The technical problem to be solved by the present disclosure is shown below: in order to solve the problems of poor stability, large folding volume and inconvenience of carriage of the folding desks in the prior arts, the present disclosure provides a folding desk.

In order to address the above technical problems, the following technical solution is employed: there is provided a folding desk, which includes a desk body and a desk board. The desk body includes four support mechanisms, two first linkage mechanisms and two second linkage mechanisms. The support mechanisms include upright rods and cross beam rods with ends hinged together, where four upright rods are distributed in rectangle. First connection pieces slidable along the upright rods are disposed on the upright rods respectively. The two upright rods at the short sides of the rectangle are connected by the first linkage mechanism. Each of the first linkage mechanisms includes two first linkage rods which are intersected and hinged to each other at an intersection point. Upper ends of the two first linkage rods are hinged respectively to upper ends of the two upright rods while lower ends of the two first linkage rods are respectively hinged to two first connection pieces. Two upright rods on the long sides of the rectangle are connected by the second linkage mechanism. Each of the second linkage mechanisms includes one second connection piece and four second linkage rods. Upper ends of two second linkage rods are hinged to the second connection piece and lower ends of the two second linkage rods are hinged to corresponding first connection pieces. Lower ends of the other two second linkage rods are hinged to each other and upper ends of the other two second linkage rods are respectively hinged to upper ends of the corresponding two upright rods. Two second linkage rods between the upright rod and the second connection piece are intersected and hinged to each other at an intersection point. Two cross beam rods on a same long side of the rectangle are placed on the second connection piece and located in a same straight line. The desk board is placed on the four cross beam rods.

The present disclosure has the following beneficial effects: the folding mechanism used by the desk body of the folding desk has strong stability, and the folding desk has small folding volume and ease of carriage.

BRIEF DESCRIPTION OF THE DRAWINGS

The present disclosure will be further described below in combination with drawings and specific embodiments.

Figure 1:
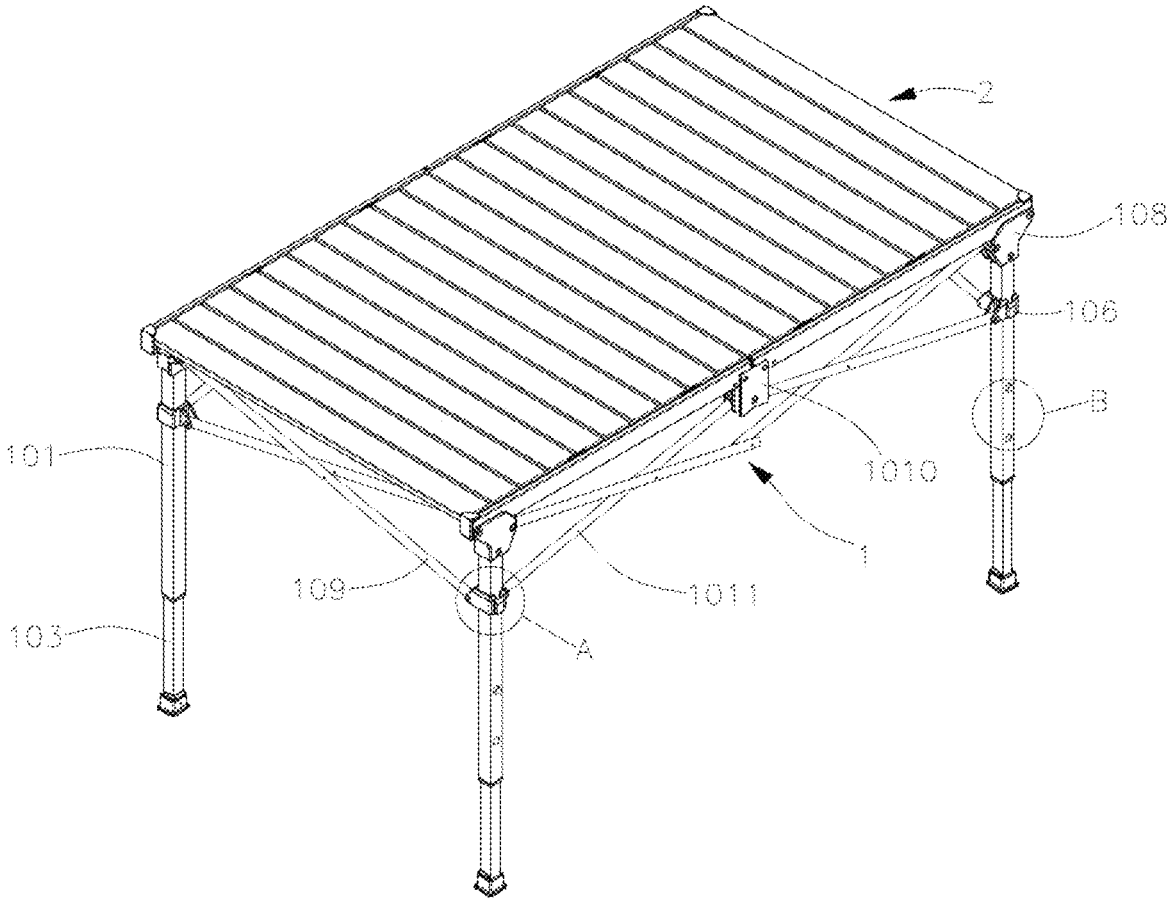
FIG. 1 is a structural schematic diagram illustrating a folding desk according to an embodiment of the present disclosure.

Numerals of the drawings are described below: 1. desk body, 2. desk board, 101. upright rod, 102. cross beam rod, 103. support foot, 104. spring pin, 105. lock hole, 106. first connection piece, 107. avoiding groove, 108. third connection piece, 109. first linkage rod, 1010. second connection piece, 1011. second linkage rod, 1012. placement groove, 1013. first positioning hole, 1014. V-shaped spring sheet, 1015. positioning protrusion, 1016. press column, 1017. cut side, 1018. step, 1019. positioning column, 1020. stop block, 201. unit block, 202. fixing strip, 203. hinging chain.

DETAILED DESCRIPTION OF THE EMBODIMENTS

The embodiments of the present disclosure are detailed below with their examples illustrated in the drawings, where same and similar numerals represent same or similar elements or elements having same or similar function throughout the specification. The embodiments described by referring to the drawings are only illustrative and used only to explain the present disclosure and shall not be understood as limiting of the present disclosure.

Figure 2:
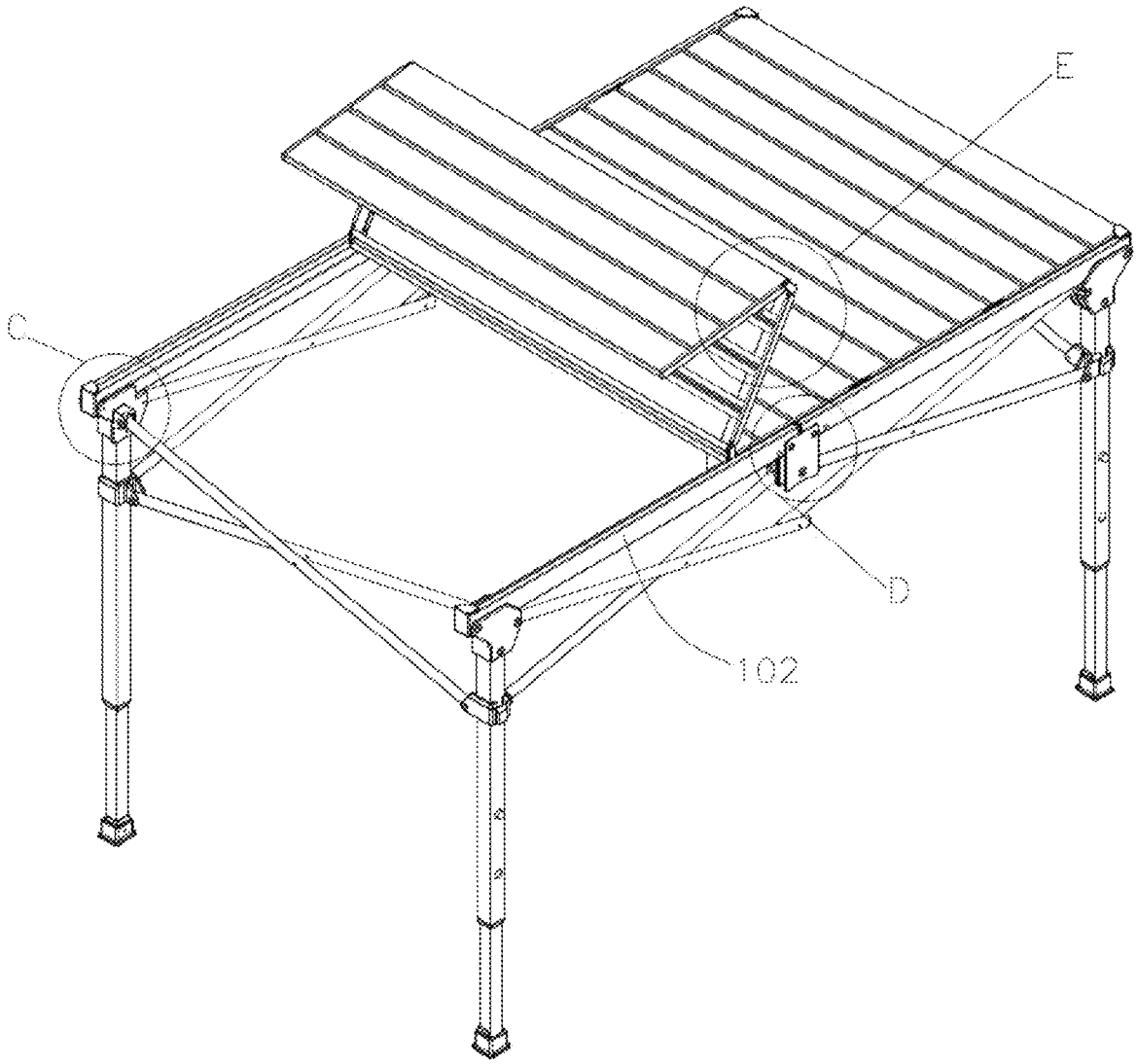
FIG. 2 is a structural schematic diagram illustrating a folding desk with a desk board lifted according to an embodiment of the present disclosure.
Figure 3:
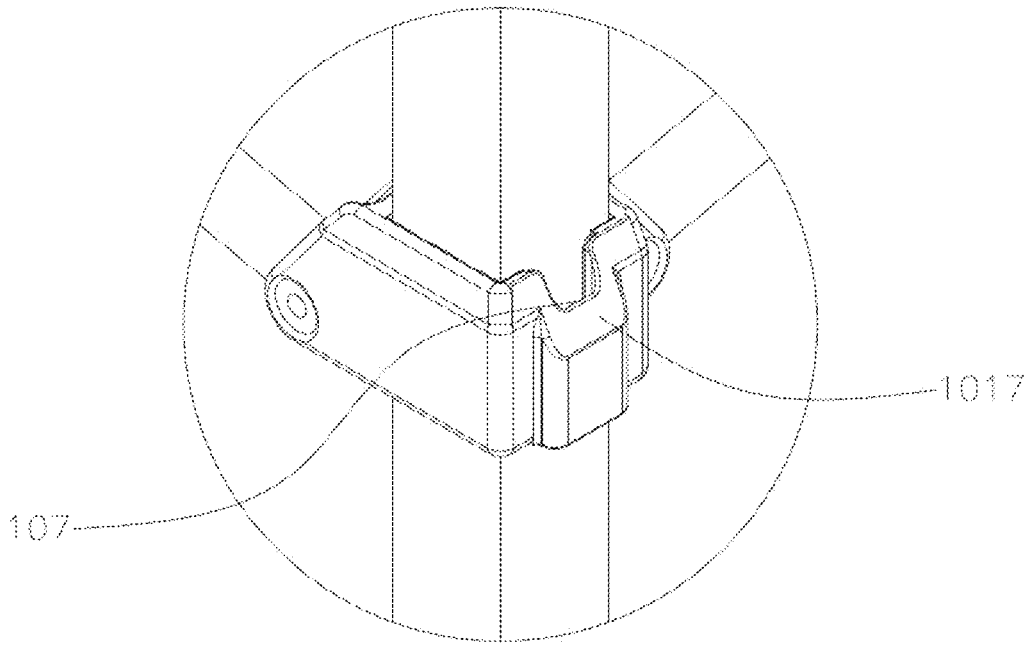
FIG. 3 is an enlarged view of the position A in FIG. 1.
Figure 4:
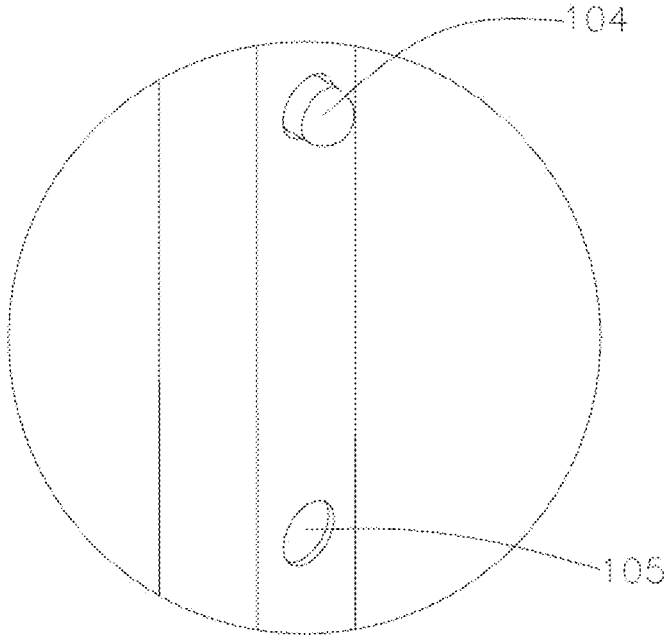
FIG. 4 is an enlarged view of the position B in FIG. 1.
Figure 5:
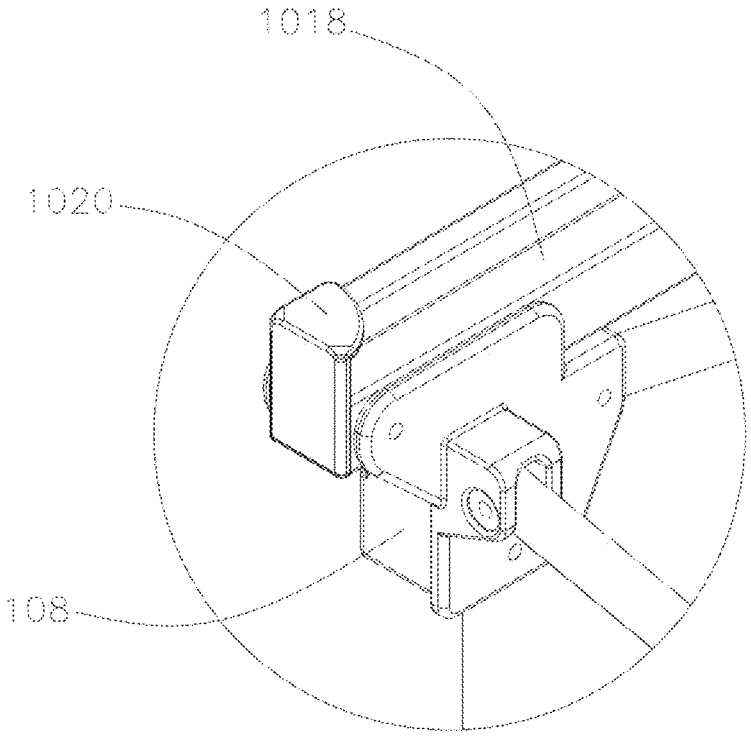
FIG. 5 is an enlarged view of the position C in FIG. 2.
Figure 6:
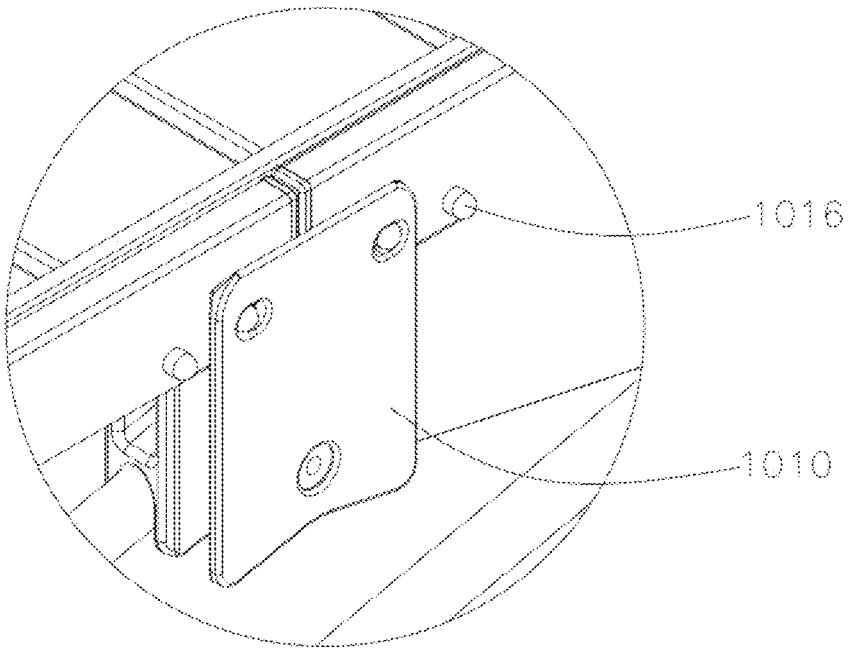
FIG. 6 is an enlarged view of the position D in FIG. 2.
Figure 7:
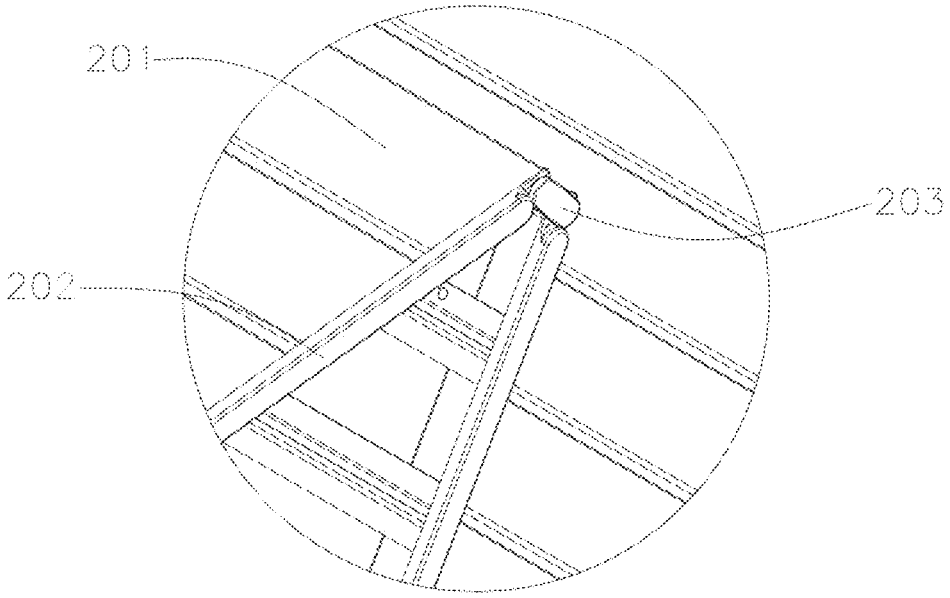
FIG. 7 is an enlarged view of the position E in FIG. 2.
Figure 8:
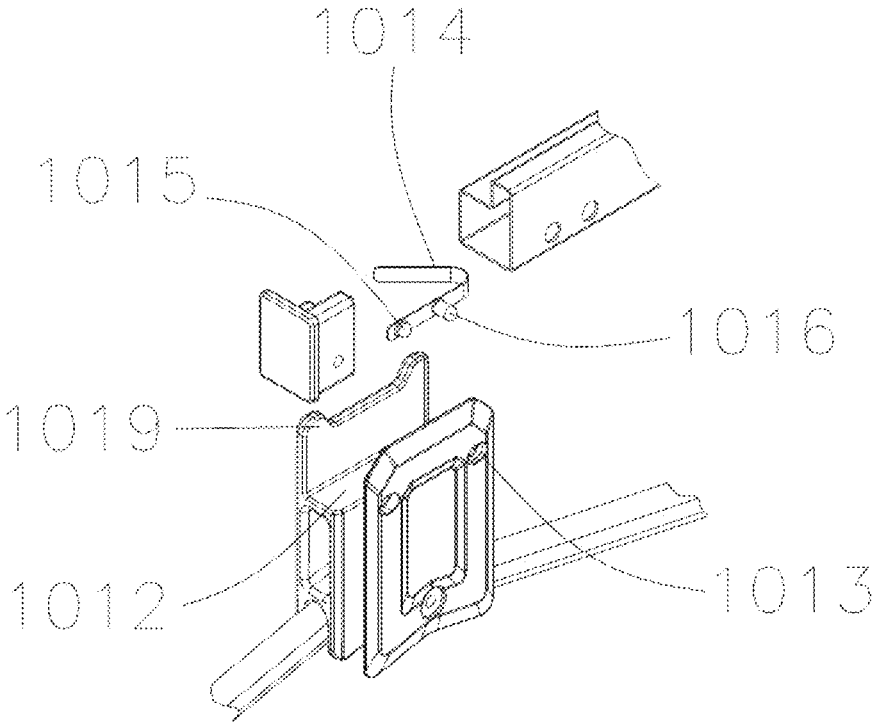
FIG. 8 is a structural schematic diagram of the position D of FIG. 2 in a disassembled state.

As shown in FIGS. 1 to 8, the present disclosure provides a folding desk, which includes a desk body 1 and a desk board 2. The desk body 1 includes four support mechanisms, two first linkage mechanisms and two second linkage mechanisms. The support mechanisms include upright rods 101 and cross beam rods 102, where four upright rods 101 are distributed in rectangle, and an insertion type support foot 103 is provided at a lower end of each upright rod 101. A telescoping spring pin 104 is mounted on the support feet 103 respectively, and a lock hole 105 for fixing the spring pin 104 is disposed on the upright rods 101 respectively. By pulling the support feet 103, an insertion depth of the support feet 103 into the upright rods 101 may be adjusted so as to realize adjustment to a desktop height. In some embodiments, the desk body 1 includes upright rods 101 with each having two lock holes 105 such that the desktop can be adjusted to three different heights: rod bodies of the support feet 103 are fully inserted into the upright rods 101 to enable the desktop to be at a lowest height; the spring pins 104 are inserted into the upper lock holes 105 to enable the desktop to be at a medium height; and the spring pins 104 are inserted into the lower lock holes 105 to enable the desktop to be at a highest height. This configuration provides flexible height adjustment and thus quick and simple height adjustment can be carried out based on different use requirements and individual comforts. A first connection piece 106 slidable along the upright rods 101 is disposed on the upright rods 101 respectively. The spring pins 104 may partially protrude out of surfaces of the upright rods 101 when inserted into the lock holes 105. In this case, in order to prevent this protrusion from affecting the slide of the first connection pieces 106, an avoiding groove 107 is disposed at an inner side of each first connection piece 106. The avoiding grooves 107 guarantee the first connection pieces 106 can smoothly slide on the upright rods 101 even when the spring pins 104 are in a locked state. A third connection piece 108 is fixedly mounted at an upper end of the upright rods 101. A first end of the cross beam rods 102 is connected with the third connection piece 108 by hinging such that the cross beam rods 102 can rotate around their respective first ends in a vertical plane parallel to the long sides of the rectangle. The two upright rods 101 at the short sides of the rectangle are connected by the first linkage mechanism. Each of the first linkage mechanisms includes two first linkage rods 109 which are intersected and hinged to each other at an intersection point. Upper ends of the two first linkage rods 109 are hinged respectively to the third connection pieces 108 on the two upright rods 101 while their lower ends are respectively hinged to two first connection pieces 106. Two upright rods 101 on the long sides of the rectangle are connected by the second linkage mechanism. Each of the second linkage mechanisms includes one second connection piece 1010 and four second linkage rods 1011. In the four second linkage rods 1011, upper ends of two second linkage rods 1011 are hinged to the second connection piece 1011 and lower ends of the two second linkage rods 1011 are hinged to corresponding first connection pieces 106; lower ends of the other two second linkage rods 1011 are hinged to each other and upper ends of the other two second linkage rods 1011 are respectively hinged to the third connection pieces 108 on the corresponding two upright rods 101; two second linkage rods 1011 between the upright rod 101 and the second connection piece 1010 are intersected and hinged to each other at an intersection point.

In some embodiments, the structures of the first linkage rods 109 and the second linkage rods 1011 have the following characteristics: a distance between their upper ends and their intersection point is set to be less than a distance between their lower ends and their intersection point. In this unique structure design, when the folding desk is unfolded, four upright rods 101 will be slightly tilted outwardly. This slight tilt increases a bottom area of the folding desk and hence improves the use stability of the folding desk. This tilt design not only optimizes the mechanical property of the desk to ensure the safety and stability in use but also allows the desk to bear a larger load without collapse. The mechanical logic and design thought obviously improve the practical value of the product and enable the product to adapt to various use environments and requirements. The two upright rods 101 on the short sides of the rectangle are connected by the first linkage mechanism such that, when the desk body 1 is unfolded or folded, the two upright rods 101 can run away from each other or close to each other. Likewise, the two upright rods 101 on the long sides of the rectangle are connected by the second linkage mechanism such that, when the desk body 1 is unfolded or folded, the two upright rods 101 can run away from each other or close to each other.

A placement groove 1012 for placing the cross beam rod 102 is disposed on the second connection pieces 1010 respectively and a first positioning hole 1013 is disposed on a sidewall of the grooves. A V-shaped spring sheet 1014 is mounted inside the cross beam rods 102. The V-shaped spring sheet 1014 includes a positioning protrusion 1015 and a press column 1016 both penetrating through the cross beam rod 102. When two cross beam rods 102 on a same long side of the rectangle are rotated to be in a same straight line, one end of each cross beam rod 102 is embedded into the corresponding placement groove 1012. In this configuration, the positioning protrusion 1015 of each cross beam rod 102 is inserted into the corresponding first positioning hole 1013 to ensure the two cross beam rods 102 are fixed. At this time, second ends of the two cross beam rods 102 are held against each other, forming a complete straight line. Thus, the desk body 1 is in a fully-unfolded state. Since the ends of the cross beam rods 102 are held against each other and are locked by the corresponding positioning protrusions 1015, the two upright rods 101 on the long sides of the rectangle are effectively prevented from running close to each other, so as to ensure the stability and firmness of the desk body 1 in an unfolded state. When the desk body 1 is to be folded, the operator may press, by hand, the press columns 1016 protruding out of the cross beam rods 102. In this operation, the V-shaped spring sheets 1014 will deform to enable the positioning protrusions 1015 on the cross beam rods 102 to separate from the corresponding first positioning holes 1013. Once the positioning protrusions 1015 are released, the cross beam rods 102 can be easily rotated away from the corresponding placement grooves 1012. This process simplifies the shift of the desk body 1 from the unfolded state to the folded state, and therefore the user can quickly and conveniently adjust the structure of the desk body 1.

An inclined cut side 1017 is disposed on an upper edge of each of the first connection pieces 106. When the desk body 1 is unfolded, the inclined cut sides 1017 can enable the first connection pieces 106 to smoothly slide through even when coming in contact with the ends of the cross beam rods 102, ensuring the slide is free from the influence of the nearby cross beam rods 102. Furthermore, when the desk body 1 and the desk board 2 are to be folded and stored in a storage bag, the inclined cut sides 1017 guarantee the desk board 2 will not encounter any obstacle when coming in contact with the first connection pieces 106, facilitating operation and storage. This structure ensures the use of the product and the efficiency and convenience of the storage process.

The desk board 2 includes multiple desk board assemblies with each including four unit blocks 201. Short sides of these unit blocks 201 are fixedly connected by a fixing strip 202. Furthermore, two adjacent desk board assemblies are connected by a hinging chain 203. The desk board assemblies are connected by the hinging chain 203 such that the adjacent assemblies can rotate around a hinging point, increasing the flexibility of the desk board 2. When the desk board 2 is to be folded, two adjacent desk board assemblies are folded in half simply along the corresponding hinging chain 203, so as to realize compact storage of the desk board 2. In some other embodiments, the desk board 2 is composed of multiple paralleled unit blocks 201, where these unit blocks 201 are connected in series by an elastic rope. The elastic rope not only serves as a physical connection medium but also provides a desired elasticity, such that the desk board 2 has higher flexibility. With this structure, the desk board 2 can be folded or rolled up, which greatly facilitates carriage and storage. For example, a rubber rope or another rope with good elasticity may be used as the elastic rope to ensure reliability and durability of the connection.

The cross beam rods 102 each have a step 1018 descending toward an inner side of the desk body 1 to provide an accurate limiting function for placement of the desk board 2. A positioning column 1019 is disposed on each of the second connection pieces 1010 and a second positioning hole matching the positioning column 1019 is opened on the desk board 2. When the desk board 2 is fully unfolded and placed on the step 1018, the cross beam rods 102 can achieve limitation for the desk board 2 by the step 1018 along a direction parallel to the short sides of the rectangle. Furthermore, the positioning columns 1019 are inserted into the corresponding second positioning holes such that the desk board 2 can be limited along a direction parallel to the long sides of the rectangle and the structural stability of the cross beam rods 102 is also enhanced, so as to prevent their deformation under a load.

A stop block 1020 is provided at an end of each cross beam rod 102 respectively to stop a corner of the desk board 2 from overturning. The four corners of the desk board 2 are respectively embedded below these stop blocks 1020 so as to ensure the desk board 2 can maintain stability during use, preventing the desk board 2 from overturning due to external force or misoperation. This structure not only increases the stability of the desk but also improves the use safety, ensuring the desktop is always flat and can be applied to various scenarios.

In the descriptions of the present disclosure, the descriptions made by referring to the terms such as "one embodiment", "some embodiments", "examples", "specific examples", or "some examples" or the like are meant to refer to that the specific features, structures, materials or characteristics described in combination with the embodiments or examples are included in at least one embodiment or example of the present disclosure. In the specification, the illustrative descriptions for the terms do not necessarily refer to same embodiments or examples. Furthermore, the specific features, structures, materials or characteristics described herein may be combined in any proper way in one or more embodiments or examples.

Enlightened by the ideal embodiments of the present disclosure, those skilled in the arts can make various variations or modifications to the contents mentioned above without departing from the technical idea of the present disclosure. The technical scope of the present disclosure is not limited to the contents of the present disclosure but determined by the claims appended hereto.

What is claimed is:

1. A folding desk, comprising a desk body and a desk board, wherein the desk body comprises four support mechanisms, two first linkage mechanisms and two second linkage mechanisms, the support mechanisms comprise upright rods and cross beam rods with ends hinged together, four upright rods are distributed in a rectangle, and first connection pieces slidable along the upright rods are disposed on the upright rods respectively;

the two upright rods at short sides of the rectangle are connected by the first linkage mechanism, each of the first linkage mechanisms comprises two first linkage rods intersected and hinged to each other at a first intersection point, upper ends of the two first linkage rods are hinged respectively to upper ends of the two upright rods while lower ends of the two first linkage rods are respectively hinged to two first connection pieces;

two upright rods on long sides of the rectangle are connected by the second linkage mechanism, and each of the second linkage mechanisms comprises a second connection piece and four second linkage rods; wherein, upper ends of two second linkage rods are hinged to the second connection piece and lower ends of the two second linkage rods are hinged to corresponding first connection pieces; lower ends of the other two second linkage rods are hinged to each other and upper ends of the other two second linkage rods are respectively hinged to upper ends of the corresponding two upright rods; two second linkage rods between the upright rod and the second connection piece are intersected and hinged to each other at a second intersection point;

two cross beam rods on a same long side of the rectangle are placed on the second connection piece and located in a same straight line; and the desk board is placed on the four cross beam rods;

wherein a placement groove for placing the cross beam rod is disposed on the second connection pieces respectively, a first positioning hole is disposed on a sidewall of the placement grooves, a V-shaped spring sheet is mounted inside the cross beam rods, and the V-shaped spring sheet comprises a positioning protrusion and a press column both penetrating through the cross beam rod.

2. The folding desk of claim 1, wherein a support foot is inserted into a lower end of each upright rod, a telescoping spring pin is mounted on the support feet respectively, and at least one lock hole for fixing the telescoping spring pin is disposed on the upright rods respectively.

3. The folding desk of claim 2, wherein a distance between the upper ends of the first linkage rods and the first intersection point of the first linkage rods is less than a distance between the lower ends of the first linkage rods and the first intersection point of the first linkage rods; and a distance between the upper ends of the second linkage rods and the second intersection point of the second linkage rods is less than a distance between the lower ends of the second linkage rods and the second intersection point of the second linkage rods.

4. The folding desk of claim 3, wherein an avoiding groove for avoiding the telescoping spring pin is disposed at an inner side of each first connection piece.

5. The folding desk of claim 4, wherein the cross beam rods each have a step descending toward an inner side of the desk body, the desk board is placed on the step, a positioning column is disposed on each second connection piece, and a second positioning hole matching the positioning column is opened on the desk board.

6. The folding desk of claim 5, wherein a stop block for blocking corners of the desk board is provided at an end of each cross beam rod.

7. The folding desk of claim 6, wherein an inclined cut side is disposed on an upper edge of each of the first connection pieces.

8. The folding desk of claim 7, wherein a third connection piece is fixed at an upper end of each upright rod, and the cross beam rods, the first linkage rods and the second linkage rods are all hinged to the corresponding third connection pieces.

9. The folding desk of claim 8, wherein the desk board comprises multiple paralleled unit blocks and an elastic rope connecting multiple unit blocks in series.

10. The folding desk of claim 8, wherein the desk board comprises multiple desk board assemblies with each comprising at least two unit blocks, short sides of the unit blocks of each desk board assembly are fixedly connected by a fixing strip, and two adjacent desk board assemblies are hinged by a hinging chain.

* * * * *